US007548627B2

(12) United States Patent
Takase et al.

(10) Patent No.: US 7,548,627 B2
(45) Date of Patent: Jun. 16, 2009

(54) SPEAKER, AND MODULE, ELECTRONIC APPARATUS, AND DEVICE THAT USE THE SPEAKER

(75) Inventors: Tomoyasu Takase, Mie (JP); Masanori Nakano, Mie (JP); Masahide Sumiyama, Mie (JP); Hiroshi Yano, Mie (JP); Kazutaka Kubo, Mie (JP); Koji Sano, Mie (JP); Takanori Fukuyama, Mie (JP); Shigeru Tomoeda, Mie (JP); Kazuki Honda, Mie (JP); Toshiyuki Koike, Mie (JP); Masashi Kawabe, Mie (JP); Takeshi Shimokawatoko, Mie (JP)

(73) Assignee: Panasonic Corporation, Osaka (JP)

( * ) Notice: Subject to any disclaimer, the term of this patent is extended or adjusted under 35 U.S.C. 154(b) by 330 days.

(21) Appl. No.: 10/591,984

(22) PCT Filed: Feb. 1, 2005

(86) PCT No.: PCT/JP2005/001735

§ 371 (c)(1),
(2), (4) Date: Sep. 7, 2006

(87) PCT Pub. No.: WO2005/089012

PCT Pub. Date: Sep. 22, 2005

(65) Prior Publication Data

US 2007/0147649 A1 Jun. 28, 2007

(30) Foreign Application Priority Data

Mar. 11, 2004 (JP) ..... 2004-068571
Jul. 5, 2004 (JP) ..... 2004-197562

(51) Int. Cl.
*H04R 25/00* (2006.01)

(52) U.S. Cl. ..... 381/189; 381/386

(58) Field of Classification Search ..... 381/86, 381/87, 386, 391, 392, 395, 189, 412, 414, 381/346, 347; 181/141, 149, 199
See application file for complete search history.

(56) References Cited

U.S. PATENT DOCUMENTS 4,012,605 A * 3/1977 Jasinski ..... 381/347
4,949,386 A * 8/1990 Hill ..... 381/349

FOREIGN PATENT DOCUMENTS

| | | |
|---|---|---|
| JP | 56-104295 | 8/1981 |
| JP | 60-184388 | 12/1985 |
| JP | 61-219292 | 9/1986 |
| JP | 61-258600 | 11/1986 |
| JP | 1-64283 | 4/1989 |
| JP | 1-82596 | 6/1989 |
| JP | 2-265399 | 10/1990 |
| JP | 2-268595 | 11/1990 |
| JP | 5-18197 | 3/1993 |
| JP | 7-20796 | 4/1995 |
| JP | 10-136478 | 5/1998 |

* cited by examiner

*Primary Examiner*—Huyen D Le
(74) *Attorney, Agent, or Firm*—Wenderoth, Lind & Ponack, L.L.P.

(57) ABSTRACT

A net made of material containing at least metal is bonded to a protector of a loud speaker, and hence shields electromagnetic waves. Electromagnetic interference can be prevented in an electronic apparatus such as a portable phone employing the loud speaker.

9 Claims, 8 Drawing Sheets

FIG. 12 – PRIOR ART
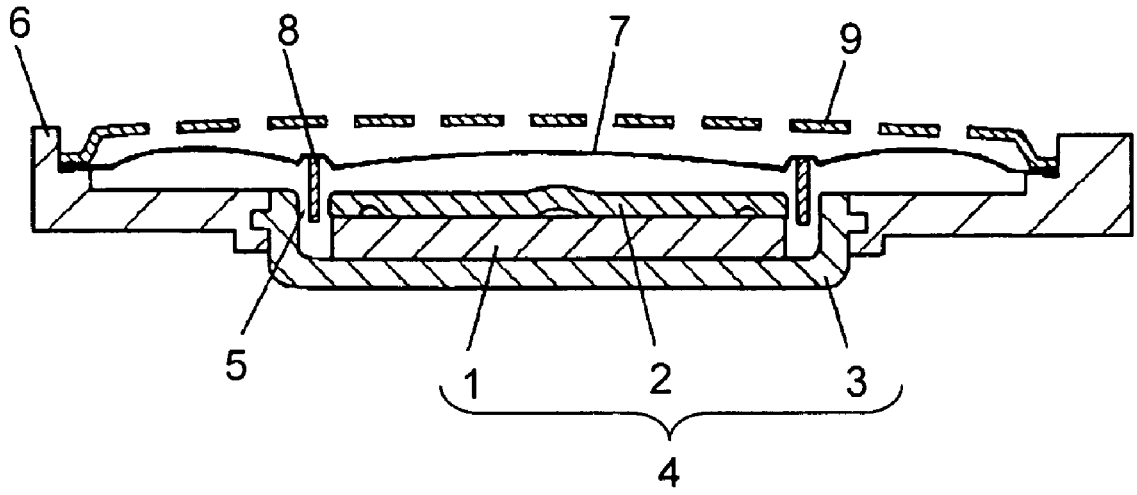

SPEAKER, AND MODULE, ELECTRONIC APPARATUS, AND DEVICE THAT USE THE SPEAKER

This application is a U.S. national phase application of PCT International Application PCT/JP05/001735.

TECHNICAL FIELD

The present invention relates to a loud speaker and a module that are used in various acoustic equipment or information communication equipment, and an electronic apparatus and device such as a portable phone or a game machine.

BACKGROUND ART

A conventional device is described with reference to FIG. 12. FIG. 12 is a sectional view of a conventional loud speaker. An internal magnetic circuit 4 is formed by sandwiching magnetized magnet 1 between upper plate 2 and yoke 3 in FIG. 12. Frame 6 is bonded to yoke 3 of magnetic circuit 4.

Diaphragm 7 is bonded to a rim part of frame 6, voice coil 8 is bonded to diaphragm 7, and voice coil 8 is engaged in and bonded to magnetic gap 5 in magnetic circuit 4. Protector 9 is bonded to frame 6 so as to cover diaphragm 7.

As an example of a conventional device related to the present invention, reference is made to Japanese Patent Unexamined Publication No. S61-258600.

The loud speaker is often used in an electronic apparatus such as a portable phone. When the loud speaker is affected by electromagnetic waves, the electromagnetic waves coming from voice coil 8 of the loud speaker, are amplified by an amplifier of the electronic apparatus such as the portable phone, generates a noise component, and causes electromagnetic interference, disadvantageously. These phenomena often occur especially in a GSM (global system for mobile communications) portable phone.

SUMMARY OF THE INVENTION

The present invention addresses the above-mentioned problems, and provides an excellent loud speaker that is hardly affected by electromagnetic waves and does not cause electromagnetic interference.

The loud speaker of the present invention has the following structure to address the problems.

The loud speaker has a frame bonded to a magnetic circuit, a diaphragm bonded to an outer periphery of the frame, and a voice coil that is bonded to the diaphragm and is partly disposed in a magnetic gap of the magnetic circuit. A protector is bonded to the frame so as to cover the diaphragm. A net made of a material containing at least metal is bonded to the protector.

Thanks to this structure, the net made of the material containing the metal shields electromagnetic waves to prevent the electromagnetic interference.

The loud speaker has a frame bonded to a magnetic circuit including a main magnet, a diaphragm bonded to an outer periphery of the frame, a voice coil that is bonded to the diaphragm and is partly disposed in a magnetic gap of the magnetic circuit, and a protector bonded to the frame so as to cover the diaphragm. A repulsion magnet is bonded to the protector at the position where the repulsion magnet faces the center pole of an upper plate or a lower plate of the magnetic circuit at a distance.

Thanks to this structure, a leakage flux occurring in the front surface direction of the magnetic circuit including the main magnet can be reduced by an effect of the repulsion magnet. The loud speaker is hardly affected by external electromagnetic waves, and the electromagnetic interference can be prevented in the electronic apparatus such as a portable phone using the loud speaker.

BRIEF DESCRIPTION OF DRAWINGS

FIG. 12 is a sectional view of a conventional loud speaker.

DETAILED DESCRIPTION OF PREFERRED EMBODIMENTS

Exemplary embodiments of the present invention will be described with reference to the drawings.

First Exemplary Embodiment

Figure 1:
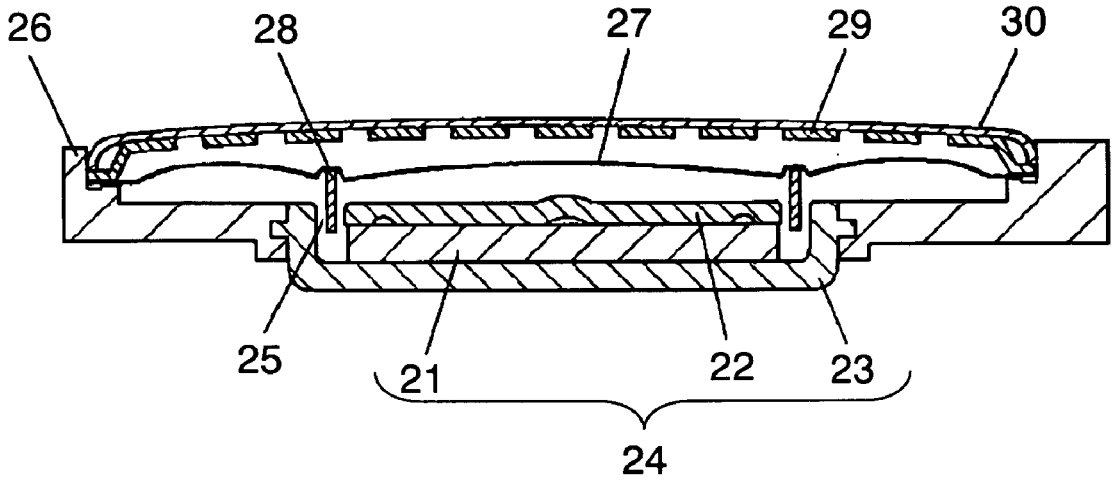
FIG. 1 is a sectional view of a loud speaker in accordance with exemplary embodiment 1 of the present invention.

FIG. 1 is a sectional view of a loud speaker in accordance with exemplary embodiment 1 of the present invention. In FIG. 1, internal magnetic circuit 24 is formed by sandwiching magnetized main magnet 21 between upper plate 22 and yoke 23.

Resin frame 26 is bonded to yoke 23 of internal magnetic circuit 24. The outer periphery of diaphragm 27 is bonded to a rim part of resin frame 26, one end of voice coil 28 is bonded to diaphragm 27, and the other end of voice coil 28 is engaged in and bonded to magnetic gap 25 of internal magnetic circuit 24.

Protector 29 is bonded to resin frame 26 so as to cover diaphragm 27, and net 30 made of a material containing at least metal is bonded to protector 29. Protector 29 is made of a resin material. Therefore, the productivity of protector 29 can be improved, and hence the productivity of the loud speaker can be improved.

Net 30 is formed by knitting a thread where a foil material made of copper, nickel, or both copper and nickel is wound on a core wire made of a resin material.

When the core wire of net 30 includes the resin material, stretchability of net 30 is improved, and net 30 can be bonded to protector 29 without clearance. When the foil material of net 30 is made of copper or nickel, the flexibility of net 30 is improved, and the electromagnetic wave shielding effect can be increased. When protector 29 is coated with metal, the electromagnetic wave shielding effect is further increased.

The component ratio between the resin material and metal material in net 30 is preferably set at a required ratio that makes use of a feature of each material. The component ratio can be adjusted according to the application. For example, when the electromagnetic wave shielding effect is intended to be increased, the component ratio of the metal material is increased. When the stretchability of the net is intended to be increased, the component ratio of the resin material is increased. Especially, when the stretchability of the net is intended to be further increased, it is effective that many fine wires made of the resin material are twisted. Besides these methods, powder of the metal material may be mixed into the resin material.

Thanks to this structure, the electromagnetic wave is shielded by the net made of the material containing metal, and the electromagnetic interference can be prevented. Since the loud speaker is hardly affected by electromagnetic waves and the electromagnetic interference is prevented, the electromagnetic interference can be prevented in the electronic apparatus such as a portable phone using this loud speaker.

Second Exemplary Embodiment

Figure 2:
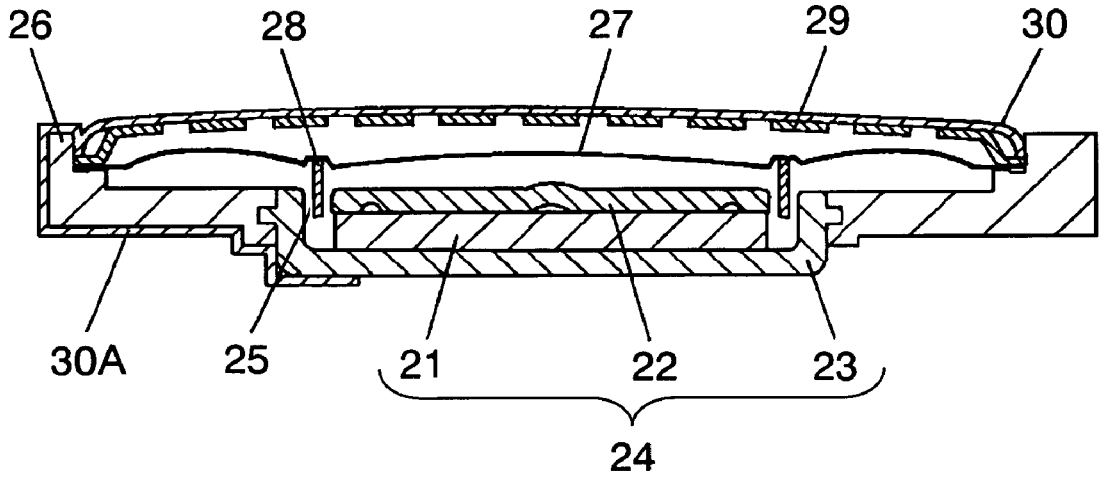
FIG. 2 is a sectional view of a loud speaker in accordance with exemplary embodiment 2 of the present invention.

FIG. 2 is a sectional view of a loud speaker in accordance with exemplary embodiment 2 of the present invention. This loud speaker differs from the loud speaker of embodiment 1 in that net 30 is bonded to internal magnetic circuit 24. A part 30A (hereinafter referred to as "net outer periphery") of the outer periphery of net 30 is enlarged and is bonded to yoke 23 of internal magnetic circuit 24.

In this structure, net 30 is grounded to internal magnetic circuit 24, thereby improving the electromagnetic wave shielding effect. When protector 29 bonded to net 30 is coated with metal, the electromagnetic wave shielding effect can be further increased.

Even when net outer periphery 30A is further enlarged and is bonded to internal magnetic circuit 24 so as to cover internal magnetic circuit 24, the shielding effect of electromagnetic wave can be increased.

Third Exemplary Embodiment

FIG. 3 through FIG. 6 are sectional views of loud speakers in accordance with exemplary embodiment 3 of the present invention.

Figure 3:
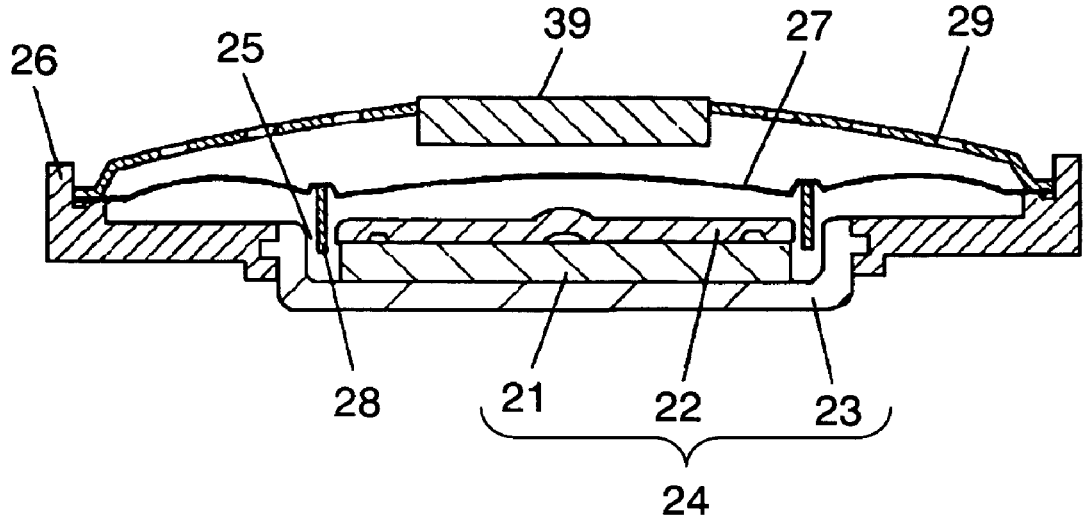
FIG. 3 is a sectional view of a loud speaker in accordance with exemplary embodiment 3 of the present invention.

In FIG. 3, internal magnetic circuit 24 is formed by sandwiching magnetized main magnet 21 between upper plate 22 and yoke 23. Resin frame 26 is bonded to yoke 23 of internal magnetic circuit 24. The outer periphery of diaphragm 27 is bonded to a rim part of resin frame 26, one end of voice coil 28 is bonded to diaphragm 27, and the other end of voice coil 28 is engaged in and bonded to magnetic gap 25 of internal magnetic circuit 24. Protector 29 is bonded to resin frame 26 so as to cover diaphragm 27, and repulsion magnet 39 is bonded to protector 29 at the position where repulsion magnet 39 faces upper plate 22 of magnetic circuit 24 at a distance.

Thanks to this structure, a leakage flux occurring in the front surface direction of internal magnetic circuit 24 including main magnet 21 can be reduced by an effect of repulsion magnet 39. The loud speaker is hardly affected by external electromagnetic waves, and the electromagnetic interference can be prevented in the electronic apparatus such as a portable phone using the loud speaker.

Respective repulsion magnetic forces of main magnet 21 and repulsion magnet 39 can increase the magnetic flux density in magnetic gap 25 of internal magnetic circuit 24, and can raise the sound pressure level of the loud speaker.

Figure 4:
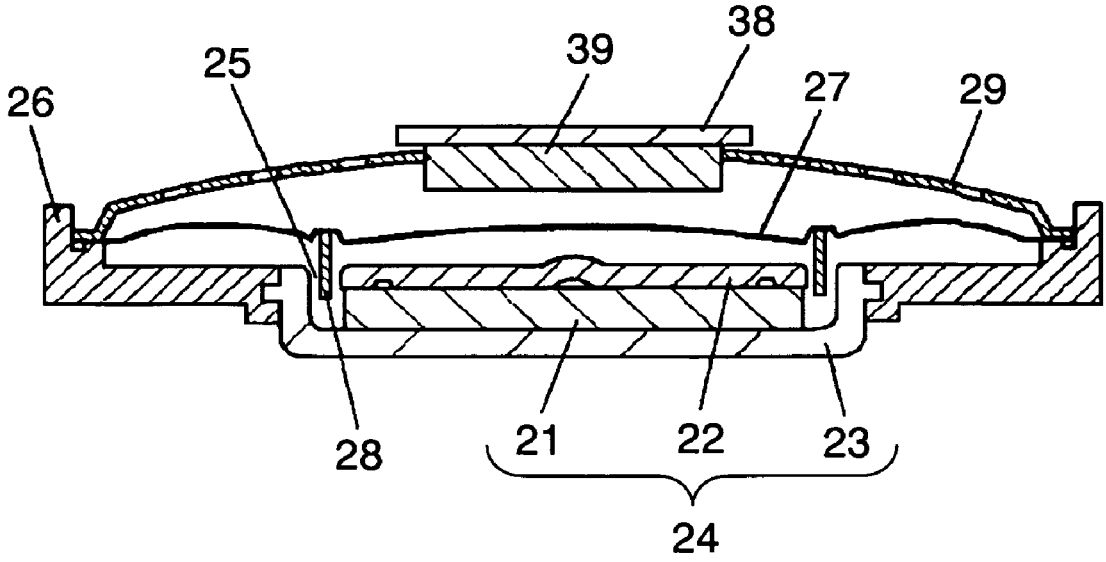
FIG. 4 is a sectional view of another loud speaker in accordance with exemplary embodiment 3 of the present invention.

Next, a structure where plate 38 is bonded to repulsion magnet 39 on the opposite side to diaphragm 27 is described in FIG. 4. Since plate 38 is bonded to repulsion magnet 39 on the opposite side to diaphragm 27 in this structure, the effect of plate 38 can significantly reduce the leakage flux that occurs from repulsion magnet 39 itself to the outside, namely in the front surface direction.

By disposing plate 38 made of magnetic material on the front surface of the loud speaker, electromagnetic waves from the outside are shielded, the effect of the waves is reduced, and the electromagnetic wave interference can be reduced.

Comparing with the case where repulsion magnet 39 is used alone, repulsion magnet 39 can be used in a stable state at an operating point, and demagnetization due to temperature change or aging can be prevented.

Figure 5:
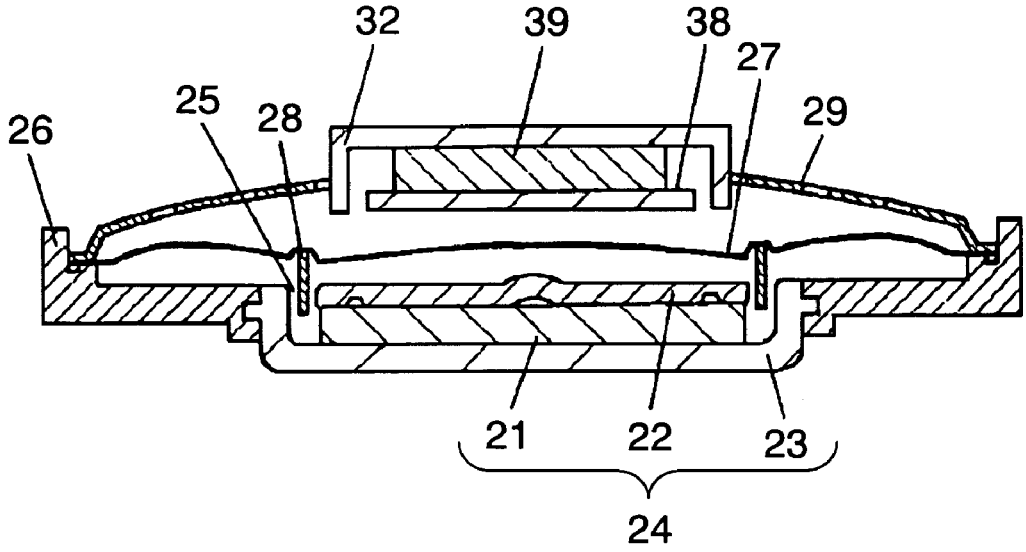
FIG. 5 is a sectional view of yet another loud speaker in accordance with exemplary embodiment 3 of the present invention.

Next, a structure where repulsion magnet 39 constitutes a magnetic circuit and is bonded to protector 29 is described with reference to FIG. 5. In this structure, repulsion magnet 39 is sandwiched between plate 38 and yoke 32 and constitutes the magnetic circuit including repulsion magnet 39, and plate 38 faces upper plate 22 of internal magnetic circuit 24 including main magnet 21.

Thanks to this structure, in addition to the effects of the structure shown in FIG. 4, the leakage flux is reduced further significantly, the electromagnetic interference is reduced, and demagnetization can be prevented by stabilizing an operation point.

When protector 29 is made of resin material in the present embodiment, the resin material can be formed by an injection molding method of one-shot, and the productivity of protector 29 can be improved. The productivity of the loud speaker can be improved.

When protector 29 is made of nonmagnetic material such as resin material, the magnetic flux generated by repulsion magnet 39 and main magnet 21 is not absorbed and hence used effectively. As these materials, in addition to the resin material, metal material such as aluminum or some stainless material is often used.

When protector 29 is made of magnetic material, protector 29 has a function of absorbing a magnetic flux by itself, and hence can prevent the leakage flux from coming to the front surface. The magnetic material can shield electromagnetic waves and can reduce electromagnetic interference.

Figure 6:
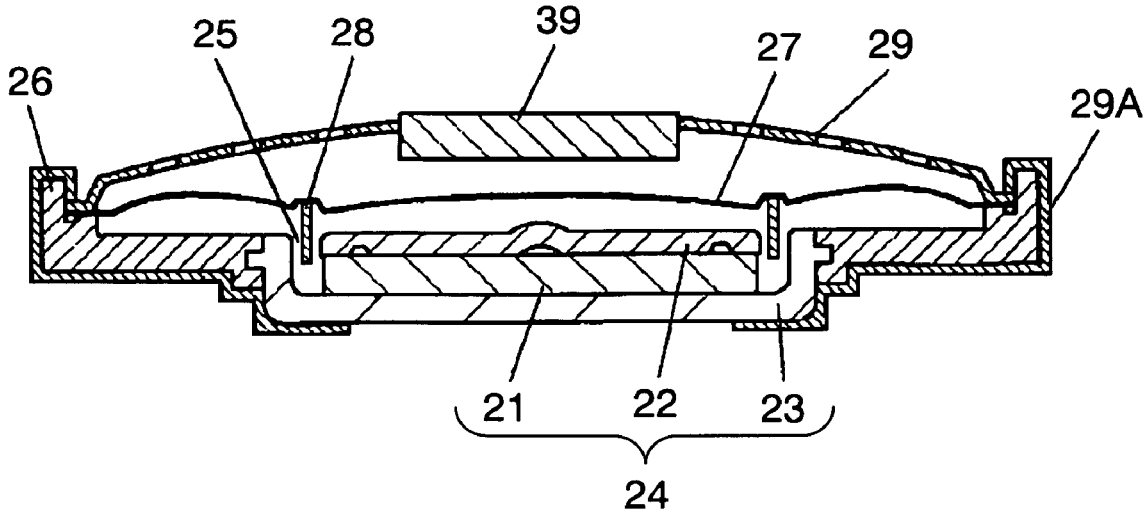
FIG. 6 is a sectional view of still another loud speaker in accordance with exemplary embodiment 3 of the present invention.

In FIG. 6, a part of protector 29 is extended, and protector extended part 29A is brought into contact with internal magnetic circuit 24 including main magnet 21. In this case, when protector 29 is grounded to internal magnetic circuit 24, a closed loop by the magnetic material including the front surface of the loud speaker can be formed, the leakage flux can be further reduced, and the electromagnetic interference can be reduced.

Fourth Exemplary Embodiment

Figure 7:
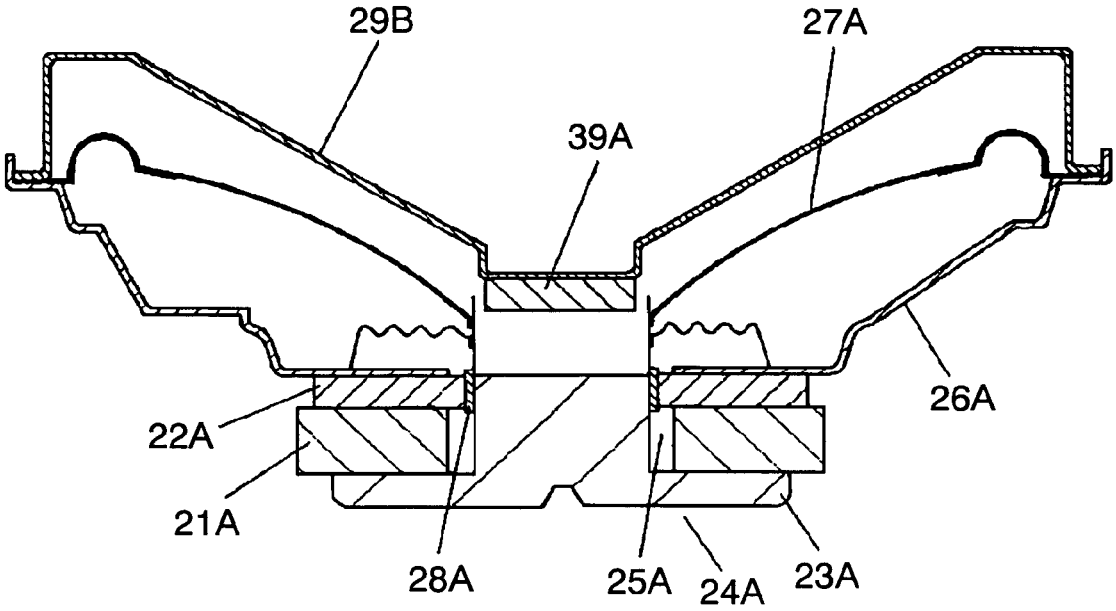
FIG. 7 is a sectional view of a loud speaker in accordance with exemplary embodiment 4 of the present invention.

FIG. 7 is a sectional view of a loud speaker in accordance with exemplary embodiment 4 of the present invention. This loud speaker differs from the loud speaker of embodiment 3 in that external magnetic circuit 24A is used as the magnetic circuit.

In this structure, magnet 21A is sandwiched between upper plate 22A and lower plate 23A to form external magnetic circuit 24A. Repulsion magnet 39A is bonded to protector 29B at the position where repulsion magnet 39A faces the center pole of lower plate 23A at a distance. Other than the structure of external magnetic circuit 24A, the structure is the same as that of embodiment 1, and further description thereof is omitted.

Figure 8:
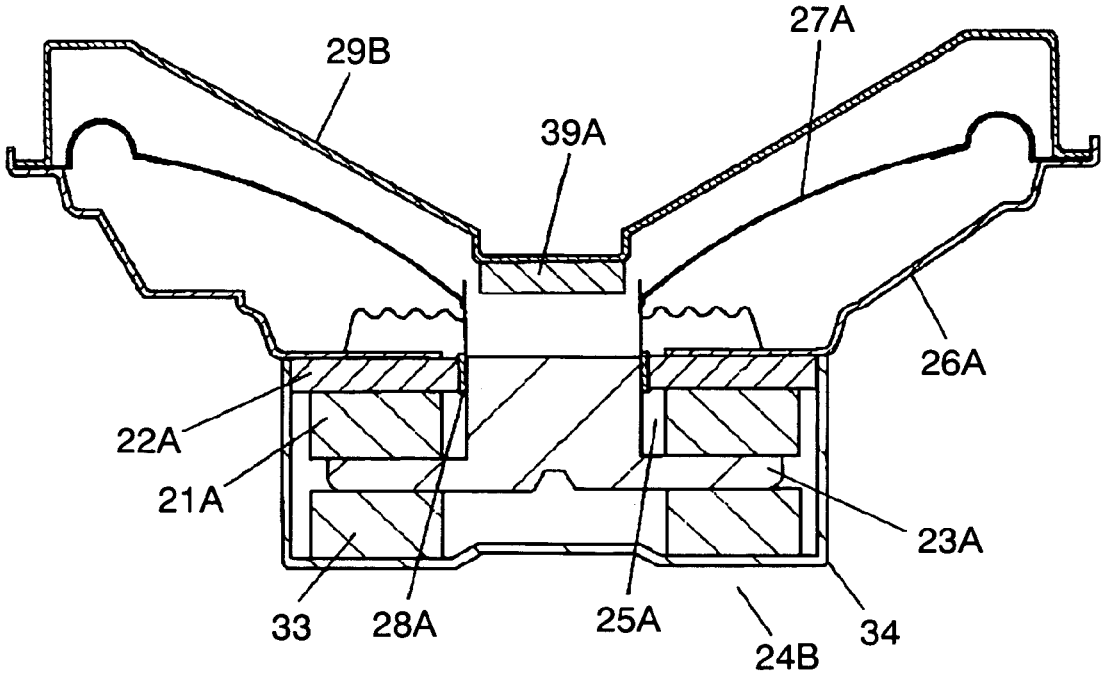
FIG. 8 is a sectional view of another loud speaker in accordance with exemplary embodiment 4 of the present invention.

In this structure having the external magnetic circuit, the leakage flux of the external magnetic circuit is reduced by employing shielded type magnetic circuit 24B that additionally has cancel magnet 33 and shield cover 34 as shown in FIG. 8. In this case in which the structure has the external magnetic circuit, shielded type magnetic circuit 24B that additionally has cancel magnet 33 and shield cover 34 can reduce the leakage flux from the back surface of the magnetic circuit to the back surface of the loud speaker.

When the front surface of the loud speaker is provided with repulsion magnet 39A that is bonded to protector 29B at the position where repulsion magnet 39A faces the center pole of lower plate 23A at a distance, the leakage flux to the front surface of the loud speaker can be reduced. Therefore, the leakage flux to both the front and back surfaces of the loud speaker can be effectively reduced, and an excellent shielded loud speaker can be realized. The sound pressure level of the loud speaker can be also improved.

The loud speaker having a circular shape that is generally often used has been described; however, the present invention is not limited to this shape. The outer shape of the frame and the shape of the magnetic circuit may be a noncircular shape. As commonly-used shapes other than the circular shape, square, rectangle, ellipse, or a truck shape may be used. These slim shapes have especially received attention because miniaturization or compaction of the loud speaker is required.

Fifth Exemplary Embodiment

Figure 9A:
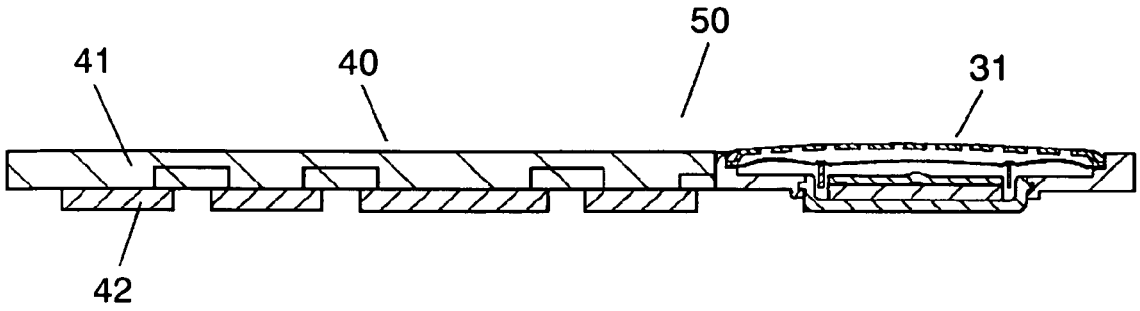
FIG. 9A is a sectional view of a loud speaker module in accordance with exemplary embodiment 5 of the present invention.

FIG. 9A is a sectional view of a loud speaker module in accordance with exemplary embodiment 5 of the present invention. In FIG. 9A, loud speaker 31 of embodiment 1 or 2 and electronic circuit 40 are integrated into loud speaker module 50.

In loud speaker module 50, electronic component 42 is fixed and wired to circuit board 41 to form electronic circuit 40. Electronic circuit 40 and loud speaker 31 of embodiment 1 or 2 are integrated into loud speaker module 50.

Electronic circuit 40 includes an amplifying circuit of a voice signal supplied to at least loud speaker 31. In other words, the circuit for amplifying the processed voice signal to a level required for an output from loud speaker 31 is previously integrated with loud speaker 31 and wired internally. Therefore, only by bonding loud speaker module 50, voice output can be easily obtained.

When electronic circuit 40 is applied to communication equipment such as a portable phone, electronic circuit 40 may include, in addition to the amplifying circuit, a circuit required for communication such as a wave detecting circuit, a modulating circuit, or a demodulating circuit, a driving circuit used for a display means such as liquid crystal, and various circuits such as a power supply circuit or a charging circuit.

Loud speaker 31 and electronic circuit 40 are conventionally produced separately, undergo respective inspection processes and physical distribution processes, and are supplied to a production site of an electronic apparatus such as a portable phone. However, thanks to this structure, loud speaker 31 and electronic circuit 40 are integrated and modularized, and hence the production processes, inspection processes, and physical distribution processes can be unified, thereby significantly reducing the cost. Therefore, inexpensive loud speaker module 50 where loud speaker 31 is bonded to electronic circuit 40 can be provided.

Figure 9B:
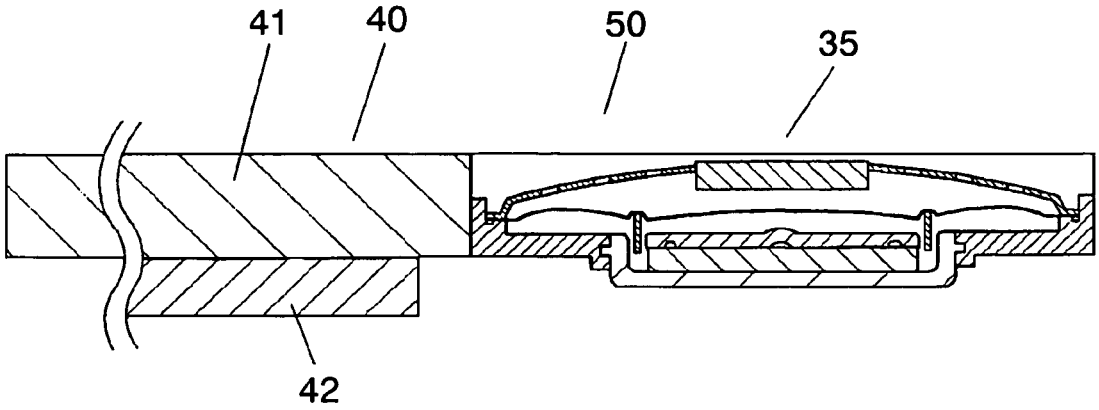
FIG. 9B is a sectional view of another loud speaker module in accordance with exemplary embodiment 5 of the present invention.

Similarly, FIG. 9B is a sectional view of another loud speaker module in accordance with exemplary embodiment 5 of the present invention. In FIG. 9B, loud speaker 35 of embodiment 3 or embodiment 4 and electronic circuit 40 are integrated into a loud speaker module. Advantages of such a structure are the same as for the structure of FIG. 9A.

Sixth Exemplary Embodiment

Figure 10A:
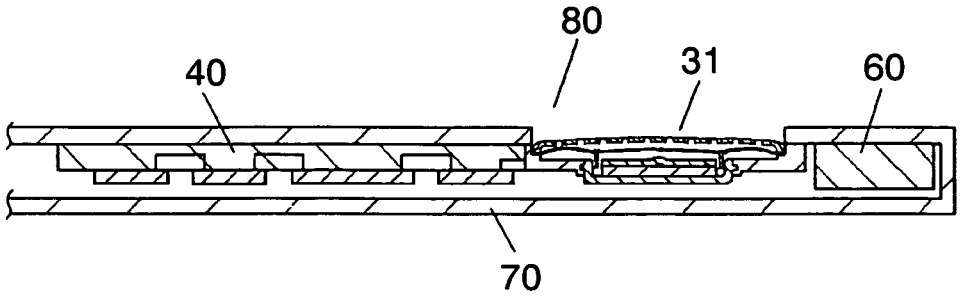
FIG. 10A is a sectional view of an essential part of an electronic apparatus in accordance with exemplary embodiment 6 of the present invention.

FIG. 10A is a sectional view of an essential part of a portable phone as an electronic apparatus in accordance with exemplary embodiment 6 of the present invention. In FIG. 10A, portable phone 80 includes loud speaker 31 of embodiment 1 or 2.

Loud speaker 31, electronic circuit 40, various components such as display module 60 such as liquid crystal, a module, and the like are mounted in exterior case 70 to form the essential part of portable phone 80.

Thanks to this structure, loud speaker 31 is hardly affected by electromagnetic waves and electromagnetic interference does not occur, so that electromagnetic interference can be prevented in an electronic apparatus such as portable phone 80 employing loud speaker 31.

Figure 10B:
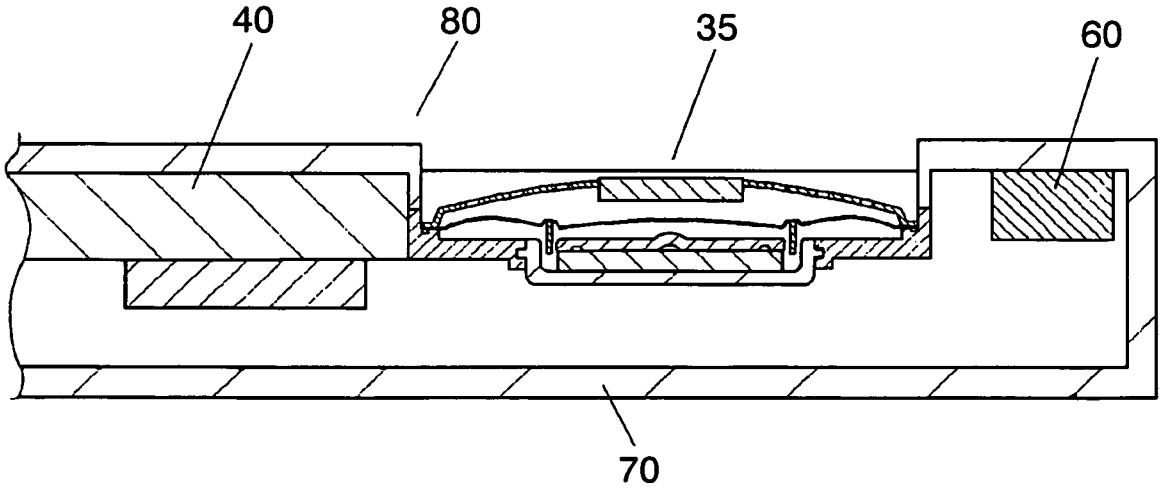
FIG. 10B is a sectional view of an essential part of another electronic apparatus in accordance with exemplary embodiment 6 of the present invention.

FIG. 10B is a sectional view of an essential part of another portable phone as an electronic apparatus in accordance with exemplary embodiment 6 of the present invention. In FIG. 10B, portable phone 80 includes loud speaker 35 of embodiment 3 or 4.

Loud speaker 35, electronic circuit 40, various components such as display module 60 such as liquid crystal, a module, and the like are mounted in exterior case 70 to form the essential part of portable phone 80.

Thanks to this structure, leakage flux of an electronic apparatus such as portable phone 80 can be reduced, the electronic apparatus such as portable phone 80 is hardly affected by external electromagnetic waves, and electromagnetic interference can be prevented. By improving the sound pressure level of loud speaker 35, the sound pressure level of the electronic apparatus such as portable phone 80 can be improved. Therefore, the electronic apparatus such as portable phone 80 can save energy.

Seventh Exemplary Embodiment

Figure 11A:
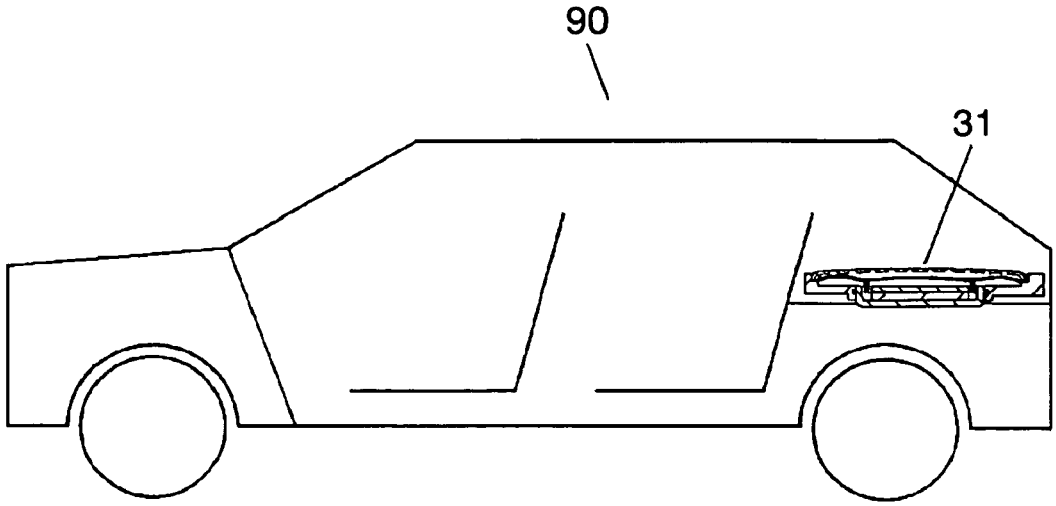
FIG. 11A is a sectional view of a device in accordance with exemplary embodiment 7 of the present invention.

FIG. 11A is a sectional view of an automobile as a device in accordance with exemplary embodiment 7 of the present invention. As shown in FIG. 11A, in automobile 90, loud speaker 31 of embodiment 1 or 2 is assembled into a rear tray or a front panel, and is used as a part of a car navigation system or car audio system.

Thanks to this structure, loud speaker 31 is hardly affected by electromagnetic waves and electromagnetic interference does not occur. Therefore, electromagnetic interference can be prevented in a device such as automobile 90 employing loud speaker 31.

Figure 11B:
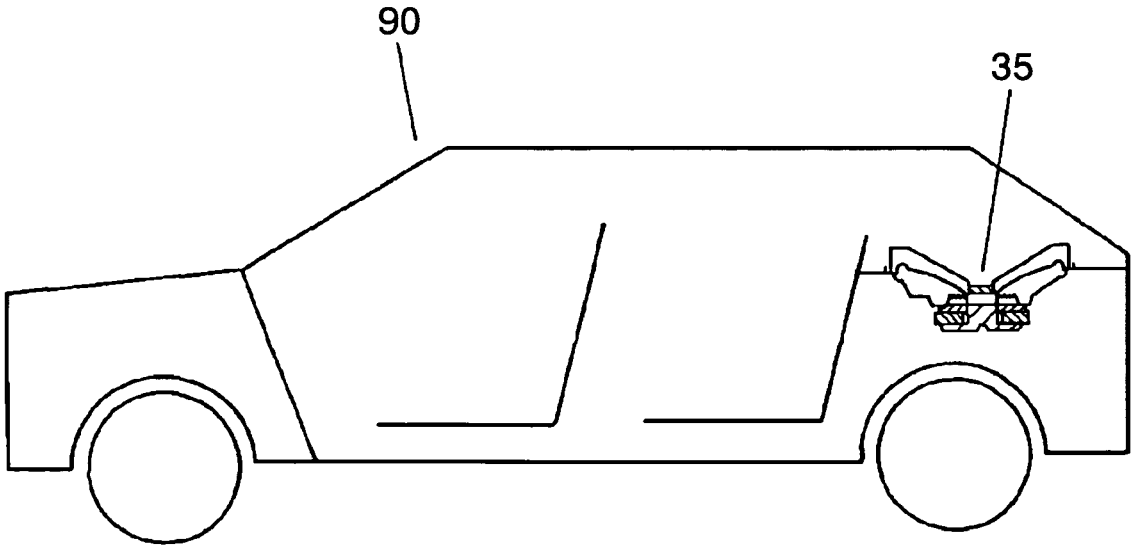
FIG. 11B is a sectional view of another device in accordance with exemplary embodiment 7 of the present invention.

FIG. 11B is a sectional view of another automobile as a device in accordance with exemplary embodiment 7 of the present invention. As shown in FIG. 11B, in automobile 90, loud speaker 35 of embodiment 3 or 4 is assembled into the rear tray or the front panel, and is used as a part of the car navigation system or car audio system.

Thanks to this structure, leakage flux from loud speaker 35 of the device such as automobile 90 can be reduced, the device such as automobile 90 is hardly affected by external electromagnetic waves, and electromagnetic interference can be prevented. By improving the sound pressure level of loud speaker 35, the sound pressure level of the device such as automobile 90 can be improved. Therefore, the fuel consumption of the device such as automobile 90 can be reduced, and global environment can be protected.

INDUSTRIAL APPLICABILITY

A loud speaker, a loud speaker module, and an electronic apparatus and device of the present invention can be applied to video acoustic equipment or information communication equipment that require measures against electromagnetic interference, an electronic apparatus such as a game machine, and a device such as an automobile.

The invention claimed is:

1. A loud speaker comprising:

a frame bonded to a magnetic circuit;

a diaphragm bonded to an outer periphery of the frame;

a voice coil that is bonded to the diaphragm and is partly disposed in a magnetic gap of the magnetic circuit; and a protector bonded to the frame so as to cover the diaphragm, wherein a net made of material containing at least metal is bonded to the protector, and wherein the net is bonded to the magnetic circuit.

2. The loud speaker of claim 1, wherein the protector is made of resin material.

3. The loud speaker of claim 1, wherein the net contains resin material.

4. The loud speaker of claim 1, wherein the net contains copper material.

5. The loud speaker of claim 1, wherein the net contains nickel material.

6. The loud speaker of claim 1, wherein the net contains both copper material and nickel material.

7. A module formed by bonding the loud speaker of claim 1 to an electronic circuit.

8. An electronic apparatus including the loud speaker of claim 1.

9. A device including the loud speaker of claim 1.

* * * * *